United States Patent [19]

Graf

[11] Patent Number: 4,576,355

[45] Date of Patent: Mar. 18, 1986

[54] SUSPENSION HARDWARE FOR SUSPENDED CABINETS

[75] Inventor: Erhard Graf, Überlingen, Fed. Rep. of Germany

[73] Assignee: Alno-Möbelwerke GmbH & Co. KG, Pfullendorf, Fed. Rep. of Germany

[21] Appl. No.: 646,227

[22] Filed: Aug. 31, 1984

[30] Foreign Application Priority Data

Sep. 3, 1983 [DE] Fed. Rep. of Germany ..... 3331836

[51] Int. Cl.[4] ..... F16M 1/00

[52] U.S. Cl. ..... 248/544; 248/225.1; 312/245

[58] Field of Search ..... 248/544, 225.1, 476, 248/477, 495, 496, 201, 222.1, 223.1; 312/245, 246, 237, 238

[56] References Cited

U.S. PATENT DOCUMENTS

| | | | |
|---|---|---|---|
| 2,830,863 | 4/1958 | Fehr | 312/245 |
| 4,465,256 | 8/1984 | Wolbrink et al. | 248/201 X |

FOREIGN PATENT DOCUMENTS

| | | | |
|---|---|---|---|
| 2156981 | 5/1973 | Fed. Rep. of Germany | 312/245 |
| 2735095 | 2/1979 | Fed. Rep. of Germany | 312/245 |
| 2942946 | 3/1981 | Fed. Rep. of Germany | 312/245 |
| 2276019 | 1/1976 | France | 312/245 |
| 157128 | 12/1956 | Sweden | 312/245 |
| 2066063 | 7/1981 | United Kingdom | 312/245 |

*Primary Examiner*—J. Franklin Foss

*Attorney, Agent, or Firm*—Spencer & Frank

[57] ABSTRACT

Suspension hardware for suspended cabinets, particularly shelf elements, the device including a hardware housing which is attached to the rear wall of the cabinet and provided with adjustment means for an at least two-dimensional adjustment of the hardware housing with respect to the building wall while employing a screw disposed in the hardware housing. The end of the screw disposed in the interior of the cabinet is provided with engagement faces for an adjustment tool and the exterior end of the screw is provided with a head member for engaging behind a supporting strip. The length of the hardware housing approximately corresponds to the thickness of the rear wall of the cabinet. The hardware housing is provided with holding elements which rest against the front and rear of the rear wall of the cabinet and hold the hardware housing rotatably in the rear wall of the cabinet. The setscrew is disposed in a threaded through bore in the hardware housing and the disc-shaped head member fixed to the setscrew is provided with contact faces which are spaced differently from the center axis of the through bore.

9 Claims, 4 Drawing Figures

SUSPENSION HARDWARE FOR SUSPENDED CABINETS

The invention relates to suspension hardware for suspended cabinets, particularly shelf elements.

Suspension hardware for cabinets or shelf elements should permit relative displacement of the body of the cabinet in the plane of the supporting building wall and additionally limited tensioning or adjustment of the cabinet perpendicularly to the wall. It is known to effect the individual adjustments by screws that are arranged perpendicularly to one another, as described in DE-OS [Federal Republic of Germany - Laid-open Application] No. 1,429,556 or long hole connections, as described in DE-Gbm [Federal Republic of Germany - Utility Model Patent] No. 1,818,523. For lateral adjustment, fastening tongues equipped with downwardly bent hooks have been provided so as to engage in a groove disposed in a strip fastened to the wall, as described in DE-Gbm No. 1,842,041, while the height adjustment is effected sometimes by means of eccentrics or eccentrically mounted polygonal members. In another known embodiment, described in DE-OS 1,429,553, an eccentric equipped with an eccentrically arranged screw is disposed in a horizontal longitudinal slot in a housing so as to be adjustable by way of circumferential teeth. The housing here has a cylindrical projection which is fitted into a corresponding recess in the rear wall of the cabinet and is supported, on the other hand, by way of lateral edge faces in the corner of the cabinet body. Clamping to the wall and clamping of the eccentric in the hardware housing is to be effected by means of a single tensioning screw.

Another type of known suspension hardware, described in DE-PS [Federal Republic of Germany - Pat.] No. 2,166,567, is provided with an eccentric that is rotatably mounted in a hardware housing. This eccentric is provided with a threaded bore for the setscrew. Moreover, the setscrew has a head member which engages behind a supporting strip fastened to the building wall. Height and lateral adjustments are effected by means of the eccentric, while the adjustment perpendicularly to the wall is effected by means of the setscrew.

These known types of suspension hardware are all of such design that a hardware housing must be screwed to the rear wall of the cabinet, with the hardware housing accommodating the adjustment elements, such as the eccentric and the setscrew. The adjustment elements are here arranged separately in the hardware housing. This results in a voluminous housing and considerable structural expenditures.

SUMMARY OF THE INVENTION

It is an object of the invention to provide suspension hardware of the above-mentioned species such that hidden installation is possible for open cabinet and shelf elements, while simultaneously simplifying the structure. Adjustments in height, depth and to the sides are to be possible without much effort from the front on the open side of the cabinet element.

The above and other objects are achieved, according to the present invention, by a novel suspension hardware device for suspending a cabinet having a rear wall from a supporting strip mounted on a building wall in a horizontal orientation and having a recessed configuration, which hardware device includes a hardware housing member disposed in the rear wall of the cabinet and adjustment components operatively associated with the housing member for an at least two-dimensional adjustment of the housing member with respect to the building wall, the adjustment components including an adjustment screw mounted in the housing member and extending perpendicularly to the plane of the rear wall of the cabinet, with one end of the screw being disposed in the interior of the cabinet and provided with engagement faces for an adjustment tool and the other end of the screw extending behind the rear wall of the cabinet, and a head member fixed to the other end of the screw for engaging behind the supporting strip. According to principal aspects of the invention: the length of the housing member approximately corresponds to the thickness of the rear wall of the cabinet; the hardware device comprises holding elements associated with the housing member, resting against the front and rear elements of the rear wall, and holding the housing member in a manner to allow the housing member to rotate in the rear wall of the cabinet; the housing member is provided with a threaded through bore in which the screw threadedly engages; and the head member is a disc-shaped member provided along its circumference with a plurality of contact faces at different respective distances from the axis of the through bore.

With the suspension hardware according to the invention the head member, which is connected with the setscrew, is advantageously utilized for the height and lateral adjustments. The setscrew for changing the distance perpendicularly to the wall is arranged coaxially in the hardware housing so that a compact, relatively short housing results.

Other features of the invention result from the other claims, the specification and the drawings.

With the aid of the description of the drawings below showing one embodiment, the invention will now be explained in greater detail.

DESCRIPTION OF THE PREFERRED EMBODIMENTS

Figure 1:
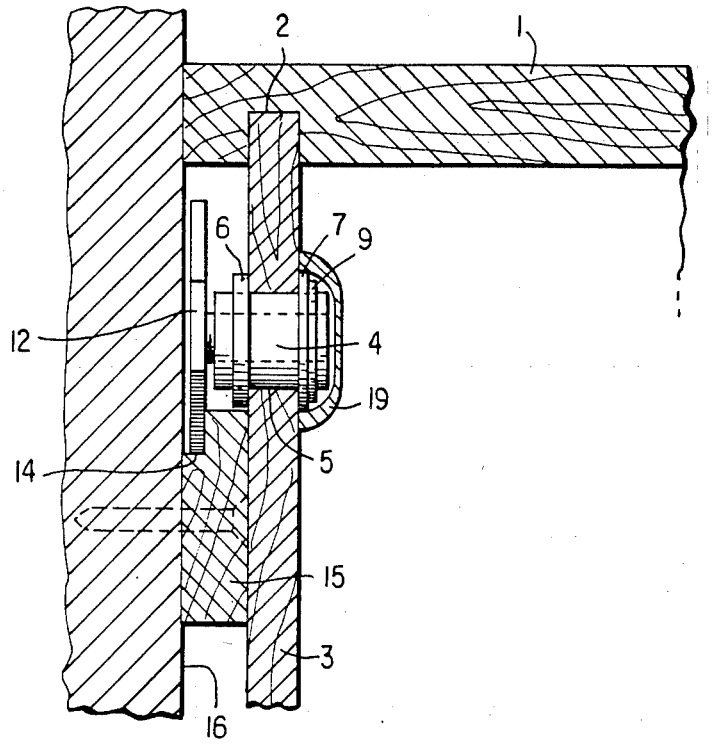
FIG. 1 is a cross-sectional view of parts of a cabinet housing with installed suspension hardware.

In the drawings, the walls of the cabinet body are marked 1 and are provided with a groove 2 to accommodate the rear wall 3 of the cabinet. The suspension hardware is disposed in a cylindrical opening of rear wall 3.

Figure 2:
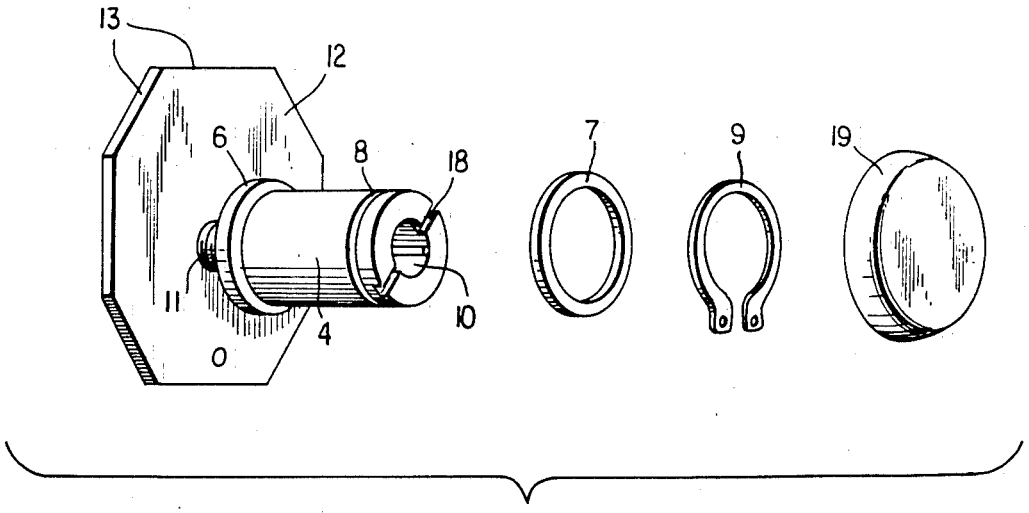
FIG. 2 is a perspective view of the parts of the suspension hardware.

The suspension hardware comprises a sleeve-shaped housing member 4 which is inserted into an opening 5 in the rear wall 3 of the cabinet. The sleeve-shaped hardware housing member 4 further comprises a disc-shaped collar 6 which is fixed thereon and which, when the suspension hardware is inserted, rests against the exterior face of rear wall 3 of the cabinet. A disc 7 is placed onto the hardware housing member on the interior rear wall of the cabinet and is held by a retaining ring 9 which engages in a groove 8 of the hardware housing members, as shown in FIGS. 1 and 2. Collar 6 and disc 7 constitute the holding elements for hardware housing member 4, as shown in FIG. 2.

It is also possible to replace disc 7 and retaining ring 9 by a threaded ring which is screwed onto a counterthread provided on sleeve-shaped housing member 4. This embodiment (not shown) permits the use of identical mounting hardware housing sleeves for different rear wall thicknesses.

Hardware housing member 4 is provided with an internally threaded through bore 10. Adjustment screw 11 is guided in bore 10 and, at its end projecting from bore 10 at the rear of the cabinet rear wall, screw 11 is provided with a disc-shaped head member 12. The disc-shaped head member 12 is rigidly connected with adjustment screw 11 and designed in such a manner that contact faces 13 provided along the circumference of the disc-shaped head member are spaced differently from the center axis of the through bore and thus from the axis of the adjustment screw.

As shown in FIG. 1, the disc-shaped head member may be designed as a polygonal disc. If the adjustment screw is fastened eccentrically on the disc or the polygon has an elongate shape, contact faces 13 disposed between the corners are then spaced differently from the center axis of the bore. In the latter case, the elongate faces lie closer to the center axis than the shorter faces (FIG. 1).

The disc-shaped head member 12 engages in a groove-shaped recess 14 in a suspension strip 15. Suspension strip 15 is fastened to the building wall 16 by means of screws.

Figure 3:
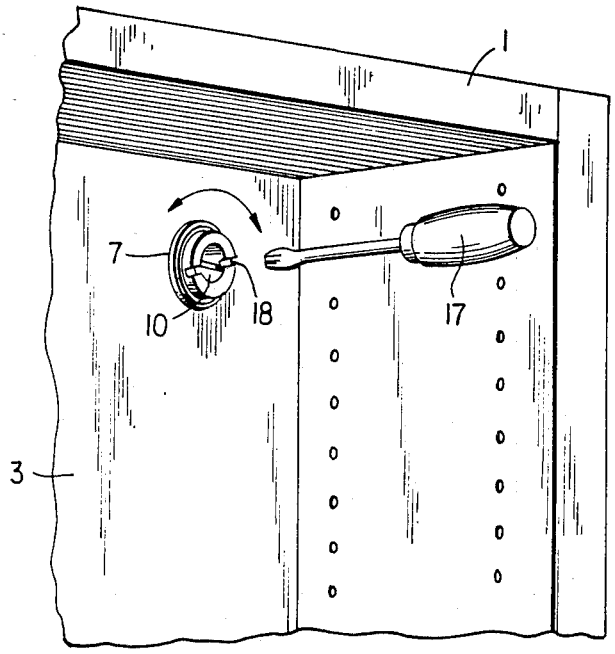
FIG. 3 shows the inner wall of a cabinet housing with suspension hardware installed.
Figure 4:
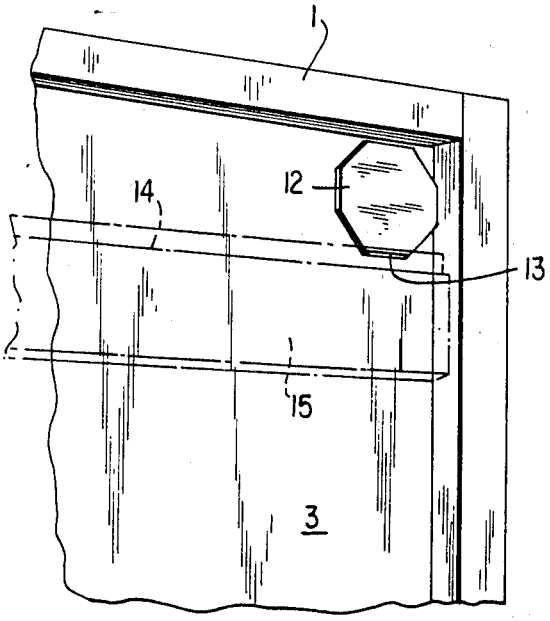
FIG. 4 shows the rear wall of a cabinet housing with suspension hardware.

The suspension hardware is adjusted in height and laterally by rotation of screw 11, as shown in FIG. 3. By means of a screwdriver 17, the adjustment screw is turned in bore 10 to the left or to the right. As a result of this rotation, another one of the contact faces of head member 12, which rotates along with screw 11, engages in the groove-shaped recess 14 of suspension strip 15, so that, due to the different distances of the contact faces from the center axis of bore 10, the body of the cabinet is raised or lowered, as can be appreciated from a consideration of FIG. 4.

To adjust the body of the cabinet perpendicularly to the wall, the hardware housing member 4 is provided with a slot 18 at its end facing the interior wall of the cabinet. Through this slot, the hardware housing can be rotated in the opening of the rear wall of the cabinet by means of a screwdriver. This causes adjustment screw 11 to be rotated, depending on the direction of rotation, either into or out of bore 10. Since head member 12 is held in groove-shaped recess 14, the body of the cabinet is moved toward the wall or away from the wall by rotation of hardware housing member 4 relative to adjustment screw 11.

The hardware housing member of the suspension hardware according to the invention can be made so short that it is possible to accommodate it completely in the rear wall of the cabinet. To cover all of the hardware, a covering cap 19 may be pushed over the end of the hardware housing. Covering cap 19 may be fastened by a latching edge member or by a projection which engages in bore 10.

I claim:

1. In a suspension hardware device for suspending a cabinet having a rear wall from a supporting strip mounted on a building wall in a horizontal orientation and having a recessed configuration, which hardware device includes a hardware housing member disposed in the rear wall of the cabinet and adjustment means operatively associated with the housing member for an at least two-dimensional adjustment of the housing member with respect to the building wall, the adjustment means including an adjustment screw mounted in the housing member and extending perpendicularly to the plane of the rear wall of the cabinet, with one end of the screw being disposed in the interior of the cabinet and provided with engagement faces for an adjustment tool and the other end of the screw extending behind the rear wall of the cabinet, and a head member fixed to the other end of the screw for engaging behind the supporting strip, the improvement wherein:

the length of said housing member approximately corresponds to the thickness of the rear wall of the cabinet;

said hardware device comprises holding elements associated with said housing member, resting against the front and rear elements of the rear wall, and holding said housing member in a manner to allow said housing member to rotate in the rear wall of the cabinet;

said housing member is provided with a threaded through bore in which said screw threadedly engages; and said head member is a disc-shaped member provided along its circumference with a plurality of contact faces at different respective distances from the axis of said through bore.

2. Suspension hardware device according to claim 1 wherein said holding elements comprise a disc-shaped collar fixed to said housing member, a slip-on disc carried by said housing member, and a retaining ring holding said slip-on disc on said housing member.

3. Suspension hardware device according to claim 1 further comprising a covering cap covering said housing member.

4. Suspension hardware device according to claim 2 further comprising a covering cap covering said housing member.

5. Suspension hardware device according to claim 2, characterized in that the slip-on disc (7) is provided with a thread and can be screwed onto a counterthread disposed on the hardware housing member.

6. Suspension hardware device according to claim 1, characterized in that the disc-shaped head member (12) is designed as a polygonal disc.

7. Suspension hardware device according to claim 1, characterized in that the screw (11) is eccentrically connected with the disc-shaped head member (12).

8. Suspension hardware device according to claim 2, characterized in that the disc-shaped head member (12) is designed as a polygonal disc.

9. Suspension hardware device according to claim 2, characterized in that the screw (11) is eccentrically connected with the disc-shaped head member (12).

* * * * *